US008670584B2

(12) United States Patent
Moran

(10) Patent No.: US 8,670,584 B2
(45) Date of Patent: Mar. 11, 2014

(54) HEARING DEVICE

(75) Inventor: Theodore F. Moran, Indianapolis, IN (US)

(73) Assignee: Theodore F. Moran, Indianapolis, IN (US)

( * ) Notice: Subject to any disclaimer, the term of this patent is extended or adjusted under 35 U.S.C. 154(b) by 0 days.

(21) Appl. No.: 13/372,670

(22) Filed: Feb. 14, 2012

(65) Prior Publication Data

US 2013/0208931 A1 Aug. 15, 2013

(51) Int. Cl.
*H04R 25/00* (2006.01)

(52) U.S. Cl.
USPC ..... 381/315; 455/41.3; 379/431

(58) Field of Classification Search
USPC ..... 381/312, 315, 320, 170, 182; 379/431; 455/41.3, 41.2
See application file for complete search history.

(56) References Cited

U.S. PATENT DOCUMENTS

| | | | | |
|---|---|---|---|---|
| 5,359,448 | A | 10/1994 | Laszlo et al. | |
| 5,596,648 | A | 1/1997 | Fast | |
| 5,812,598 | A | 9/1998 | Sharma et al. | |
| 5,818,328 | A | 10/1998 | Anderson et al. | |
| 5,881,156 | A | 3/1999 | Treni et al. | |
| 6,164,409 | A | 12/2000 | Berger | |
| 6,738,485 | B1 * | 5/2004 | Boesen | 381/312 |
| 6,823,195 | B1 | 11/2004 | Boesen | |
| 7,072,480 | B2 * | 7/2006 | Rass | 381/314 |
| 7,542,580 | B2 * | 6/2009 | Burns | 381/313 |
| 7,616,760 | B2 * | 11/2009 | Trip et al. | 379/430 |
| 7,761,091 | B2 * | 7/2010 | Dunn et al. | 455/419 |
| 7,912,237 | B2 * | 3/2011 | Fischer | 381/315 |
| 7,940,946 | B2 | 5/2011 | Caldarola | |
| 8,422,705 | B2 * | 4/2013 | Kilsgaard | 381/315 |
| 8,526,646 | B2 * | 9/2013 | Boesen | 381/312 |
| 2006/0018496 | A1 * | 1/2006 | Niederdrank et al. | 381/312 |
| 2008/0240477 | A1 * | 10/2008 | Howard et al. | 381/315 |
| 2009/0298431 | A1 * | 12/2009 | Rasmussen | 455/41.3 |
| 2010/0067723 | A1 * | 3/2010 | Bergmann et al. | 381/315 |
| 2010/0278365 | A1 * | 11/2010 | Biundo Lotito et al. | 381/315 |
| 2012/0314890 | A1 * | 12/2012 | El-Hoiydi et al. | 381/315 |

* cited by examiner

*Primary Examiner* — Curtis Kuntz
*Assistant Examiner* — Joshua Kaufman
(74) *Attorney, Agent, or Firm* — Woodard, Emhardt, Moriarty, McNett & Henry LLP

(57) ABSTRACT

Among other things, embodiments of systems for assisting hearing for individuals are disclosed. A hand-carryable transceiver having inputs for sound or other audio signals is provided, with a transmitter for transmitting digital packets or signals with identifying information relating to the transmitter. An earpiece is adapted to receive the packets or signals from the transmitter, and direct signals to a speaker on the earpiece for hearing by an individual user. Methods for making and using the system are also disclosed.

17 Claims, 3 Drawing Sheets

HEARING DEVICE

The present disclosure concerns devices for assisting those having difficulty hearing in particular situations or those having a general reduction in hearing ability. In particular, embodiments of portable systems for augmenting sound and transmitting it directly to a particular user are disclosed.

BACKGROUND

In the treatment of hearing loss, a variety of devices have been developed and used to augment the volume of or focus sound entering the sufferer's ear(s). For example, physical devices such as the ear trumpet have a narrow end for insertion into the ear canal and expands steadily out to a flared or bell end. Sound collected by the larger, flared end is directed through to the narrow end to be focused on the individual's ear drum. The trumpet can be maneuvered to some degree within the ear so that the flared end is generally pointing toward a sound of interest (e.g. a person speaking). While such focusing of sound provides a better opportunity to hear, there is no amplification of the sound volume, and of course the size of the device and the need to hold it to one's ear may make it undesirable.

Smaller, electronic personal hearing aids have been developed, many of which can be hidden behind the wearer's ear. In general, such devices acquire sound arriving at the user's ear, convert it to an electronic signal and amplify it, and send the electronic signal to a speaker in or adjacent the wearer's ear. In that way, the volume of the initial sound acquired by the hearing aid is increased, allowing the wearer's diminished hearing to receive and/or understand the sound. However, such devices also amplify background noise that is necessarily present along with conversation or other sounds the wearer desires to hear. Further, such hearing aids (having both a microphone for picking up sound and a speaker for delivering it to the wearer) can on occasion feed back, creating an unpleasant squeal. The electronic parts of such hearing aids can also be negatively affected by external devices or interference.

Systems have been developed to assist hearing using FM-based broadcasting. For example, a microphone is worn by a public speaker or other presenter, and the sound of the presenter's voice into the microphone is transmitted over an FM frequency to a fixed central receiving unit (e.g. sound board). That receiving unit then retransmits the sound over another frequency to be picked up by a radio-type receiver box, and a headphone or in-ear speaker is plugged into that receiver box, as though it were a personal music player. The size and complexity of available equipment renders such systems impossible for the user to take along with him or her. Such systems are designed for large areas such as auditoriums, theaters or churches, and for accommodating a number of users at a time. In that context, FM broadcast to and from a central receiving unit is practical and at reasonable cost.

Nonetheless, problems exist with such systems. As already indicated, such systems are built for a particular room or venue, not for continuous portable use by a particular user. The user cannot carry along the equipment used for such systems, and such equipment is generally too expensive for purchase and use by individuals in a population. Use of FM transmission also can suffer from interference from other transmissions or from electronic devices in the area. Further, it has been observed that re-transmission of FM signals as a part of a hearing-assist device can introduce an appreciable time-lag or lack of synchronization with the user's observation of the speaker or other source of sound. While some users may find that lag tolerable, it is nonetheless generally undesirable.

SUMMARY

Among other things, there are disclosed embodiments of portable devices and systems intended for individual use for direct personal transmission of sound. Particular embodiments include a transceiver having a housing sized to be carried in one or both of a user's hand and having a perimeter wall and a rechargeable power source. At least one microphone is in the perimeter wall for receiving sound from outside of the housing and converting it to an electronic audio signal, and at least one amplifier is electronically connected to the microphone(s) for amplifying the electronic audio signal (s) from the microphone(s). The transceiver may also have at least one signal input for receiving electronic audio signals from outside the housing. A processing circuit is electronically connected to the amplifier(s) and signal input(s). Certain embodiments of processing circuit have one or both of an equalizer (e.g. an noise-reducing and/or signal "cleaning" circuit or device) and a volume control (e.g. a circuit or device for increasing or decreasing gain or strength of signal(s)), with the processing circuit receiving one or both of the electronic audio signals (i.e. signals from the microphone(s) and/or from the signal input(s)) for at least one of equalization and volume alteration. A transmitter is electronically connected to the processing circuit for transmitting signals received from the processing circuit in digital packets, with the digital packets including digital information derived from the electronic audio signals and identifying information that identifies the transmitter. The transmitter transmits the digital packets at a predetermined frequency. The system further includes an earpiece having a receiver, a processing circuit and a speaker. The earpiece's receiver receives the predetermined frequency of the transmitter, and its processing circuit analyzes packets received by the receiver for the identifying information sent by the transmitter. For packets having that identifying information of the particular transmitter, the digital information derived from the electronic audio signals is passed electronically to the speaker, so that the speaker produces sound represented by the electronic audio signals.

In particular embodiments, the perimeter wall of the housing includes at least three substantially planar sides each facing in a different direction. A respective microphone is placed to face outward from at least two or each of the sides, and each such microphone has a respective amplifier. The transmitter is a Bluetooth transmitter in one embodiment, or one using the protocols and systems associated with a Bluetooth transmitter. In various embodiments, the signal input(s) includes a coaxial audio jack, a USB port, and/or an over-the-air signal receiver such as an antenna. Rechargeable power sources can be or include a battery, particularly a battery having a life after full-charging of at least twenty hours, and the transceiver or housing can include a recharging jack in said housing electronically connected to said battery. Exemplary systems can include two or more transmitters in the housing, and as many earpieces as there are transmitters, with each respective earpiece adapted to receive and process digital packets from only a respective one of the transmitters. In such cases, each transmitter is connected to the processing circuit and/or to the microphone(s) or signal input(s), directly or indirectly. Embodiments of earpieces can include a volume control.

Also disclosed are systems for assistive hearing that include an earpiece for positioning at or adjacent a user's ear, with the earpiece having a receiver, a volume control, and a speaker, and a transceiver in a housing that is sized to be carried in one or both hands of a user. The transceiver, in particular embodiments, includes at least one input for audio signals, a processor for at least one of equalizing and controlling volume related to the audio signals, and a transmitter for digitally transmitting signals from the processor. The earpiece is adapted to receive and send to its speaker only digital signals from the transmitter, so that audio signals received by the input(s) of the transceiver are transformed into sound by the speaker with no user-appreciable time lag. In embodiments in which the input(s) include at least one microphone, the housing can include external planar walls facing in different directions from each other, and at least one respective microphone can be placed in each of a plurality of those respective walls. For example, where the housing includes four external planar walls substantially forming a rectangle, the inputs can include at least one respective microphone in at least three of the planar walls. One or more inputs can be jack inputs, such as a coaxial jack input or a USB port. The housing can include a bottom surface adapted for placement on a horizontal non-floor surface, and that bottom surface may include high-friction (e.g. rubber or similar material, or suction cups) feet to minimize or eliminate movement during use. Particular embodiments of transmitters have relatively small ranges, e.g. about 1 to 200 feet.

Systems for sound communication for the hard of hearing as disclosed may include an earpiece adapted to be connected to the ear of a user, which has a receiver and processor, and a local, hand-carryable unit for receiving audio signals and transmitting audio signals to the specific earpiece. The local unit includes a receiver for receiving sound information, a processor electronically connected to the receiver for processing the sound information, a transmitter electronically connected to the processor for receiving the processed sound information and transmitting it in a transmission that includes a specific tag, code or identifier. The earpiece is in operative communication with the local unit to receive transmissions from the unit and produces sound in response to or transformed from transmissions having the specific tag, code or identifier. Such systems feature a local unit and earpiece dedicated to each other. In particular embodiments, the local unit has a housing including a circuit board, a sound input, a battery and a transmitter, with the circuit board being electronically connected to the sound input and having connected thereto an amplifier for amplifying an output of the sound input to produce an amplified output. A modulator, equalizer or processor for processing the amplified output as the user desires is provided. The transmitter receives an audio signal and transmits a digital signal with information of the audio signal and a specific tag, code or identifier at a particular frequency in a transmission. The battery provides power for the transmitter and processor, equalizer or modulator. The earpiece attaches or connects to the user's ear and has a receiver adapted to receive transmissions, and to convert transmissions from the transmitter (i.e. those having the specific tag, code or identifier to audible sound for the user. The housing is configured to be portable, so that the user can carry his or her audio enhancement system, or so that a meeting room or host can provide such a system when needed and at low cost.

DESCRIPTION OF THE ILLUSTRATED EMBODIMENTS

Figure 1:
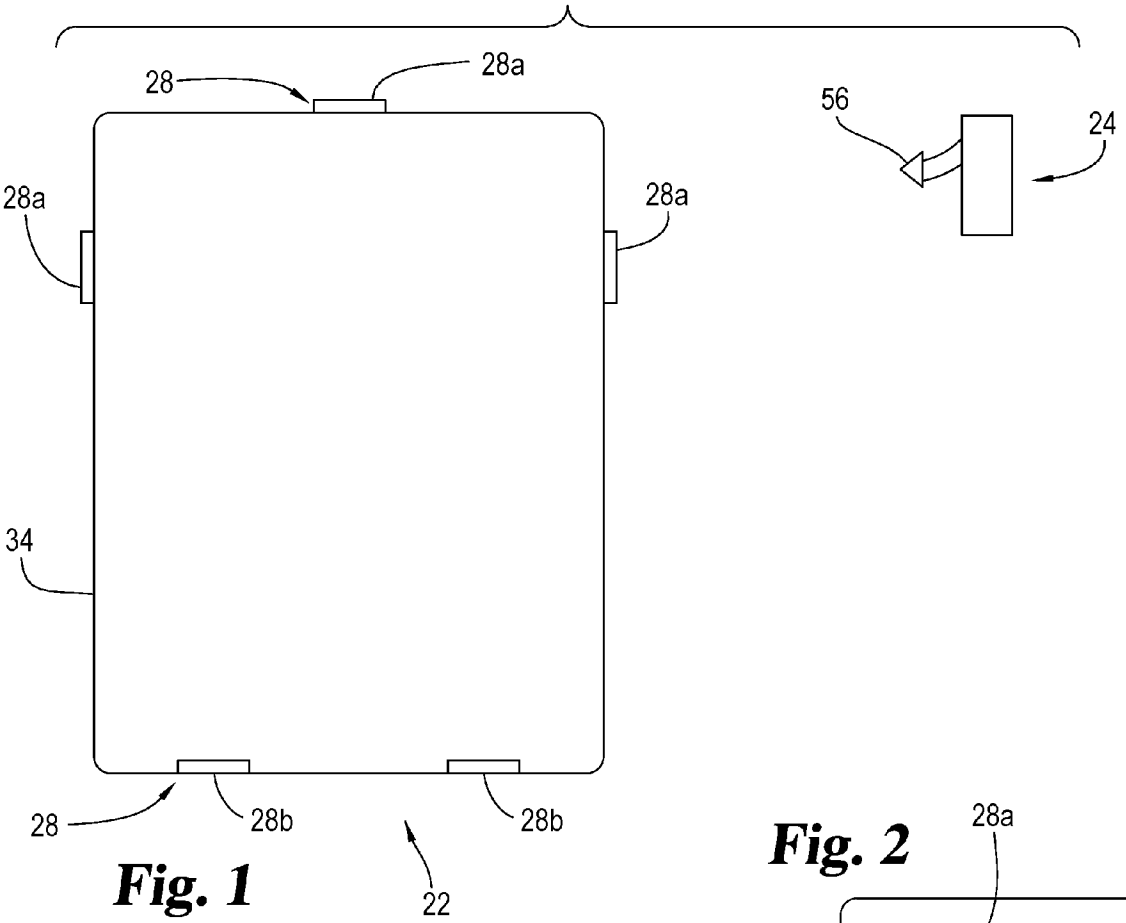
FIG. 1 is a plan representation of an embodiment of a system according to the disclosure.
Figure 2:
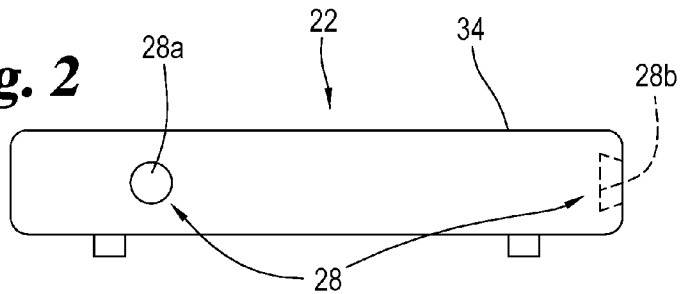
FIG. 2 is a side plan representation of the embodiment of FIG. 1.

For the purposes of promoting an understanding of the principles of the disclosure, reference will now be made to the embodiments illustrated in the drawings and specific language will be used to describe the same. It will nevertheless be understood that no limitation of the scope of the claims is thereby intended, and alterations and modifications in the illustrated devices and methods, and further applications of the principles of the disclosure as illustrated therein are herein contemplated as would normally occur to one skilled in the art to which the disclosure relates.

Referring generally to the drawings, there is shown an embodiment of a system 20 for improving audibility for those having difficulty hearing, including those suffering from long-term or short-term hearing loss. As shown in that illustrated embodiment, system 20 includes a transceiver 22 and an earpiece 24 that are specifically linked together wirelessly. System 20 does not experience the drawbacks noted above related to widespread broadcasting of FM signals.

Transceiver 22 in a particular embodiment includes one or more inputs 28 for receiving audio signals (e.g. sound or electronic signals relating to, produced by, or transformable into sound), one or more amplifiers 29 electronically connected to at least some of inputs 28 (e.g. microphone inputs), an equalization circuit or device 30 and/or volume control circuit or device 31 for reducing noise or undesirable portions of the audio signals or strengthening such signals, and a transmitter 32 for transforming the audio signals into digital information packets that also include a code or other information identifying or linked with earpiece 24 for sending the packet(s) wirelessly to earpiece 24. Transceiver 22 is a personal, portable device having a housing 34 that encloses or holds each of input(s) 28, equalization 30 and/or volume control 31 and transmitter 32 all electronically connected together, as discussed further below. It is contemplated that other electronic components may also be included in or around housing 34. In particular embodiments, housing 34 is pocket-sized, for example of up to about four to six inches (about 10 to 15 centimeters) in length, about two to four inches (about 5 to 10 centimeters) in width, and about one-half to one inch (about 1 to 2.5 centimeters) or more in height, and of a durable plastic to keep weight to a minimum. A preferred size for housing 34 is about four inches (ten centimeters) by about two inches (five centimeters), with a thickness of about one inch (2.5 centimeters) or less. The weight of transceiver 22 is such that a person can carry it in one or both hands or in a pocket or bag, e.g. about one pound (454 grams) or less. Housing 34 is generally hollow on the inside to accommodate other parts of transceiver 22.

Inputs 28 may be one or more of a number of devices, each of which is adapted to receive audio signals (e.g. sound or electronic signals representing sound). As used herein, "electronic signals representing sound" and similar phrases are intended to refer to digital or analog electronic signals made from or intended to be converted into sound, and includes electronic signals produced by a microphone that receives a sound wave as well as over-the-air signals that are to be received and converted into sound waves, as by a speaker.

Embodiments may include one or more each of microphones 28*a* and input jacks 28*b*; antenna(e) or other wireless receiver (s) can also be included. It will be understood that other embodiments may include only certain types of inputs, and/or inputs in various numbers.

Microphones 28*a* face outward from housing 34 so that sound waves striking them are converted into electronic signals representing that sound. The illustrated embodiment shows three microphones 28*a*, each on a different planar side of housing 34 and pointing outward in different directions from each other. Jack input(s) 28*b* are, as one example, female jacks into which a male prong from a source of electronic signals representing sound can be plugged. Examples of such jack inputs 28*b* are standard coaxial audio inputs and USB ports. Two such jack inputs 28*b* are shown in the example of FIG. 1. A source provides audio signals to a jack 28*b*, and the signals are transferred to transceiver 22 via the connection between the prong and the jack. Input(s) 28 that are wireless receivers are configured to receive, decode and/or transform the received electronic signals representing sound into a form usable by transceiver 22.

Particular embodiments of transceiver 22 may include only one type of input 28, for example if there is only one particular type of sound or sound-representative signal that transceiver is intended to accept. For instance, if transceiver 22 is intended for picking up the sounds of voices in a conference room, classroom or other small area, input(s) 28 may be solely microphones 28*a*. Where microphones are used, it is desirable to have a microphone input 28*a* on multiple or all sides of housing 34 (as exemplified in FIG. 1) and/or directed outward from a top surface, so as to effectively pick up sound from all or multiple directions. As another example, if transceiver 22 is desired for a particular link to a static source of sound-representative signals, such as a media player for music, spoken instruction, or entertainment (e.g. a computer or radio or television receiver) one or more jack inputs 28 may be desired. Similarly, if transceiver 22 is part of a system of traveling instruction or discussion, such as in a tour of a museum or building, wireless inputs 28 may be desired for linking with a transmitter (not shown) of a tour guide or other instructor. Of course, embodiments of transceiver 22 preferably include multiple types of inputs 28 to accommodate various sound or signal sources. Thus, in FIG. 1, transceiver 22 is shown with multiple inputs 28 around the perimeter (e.g. microphones 28*a*, oriented in different directions and a jack 28*b*). At least one internal input 28 for wireless reception of signals representing sound may also be provided. A selector (not shown) may be provided for manual input selection, to determine whether input from microphone(s) 28*a*, jack(s) 28*b* or other inputs is desired. Alternatively, input from microphone(s) 28*a* may be automatically used unless an input source is plugged into a jack 28*b*, in which case the input from jack 28*b* is used and no input from microphone(s) 28*a* is used.

The illustrated embodiment includes amplifiers 29 to amplify the audio signal received by microphones 28*a*. In particular, a respective amplifier 29 can be provided for each respective microphone 28*a*. Thus, in the example of FIG. 1, each of the three microphones 28*a* is connected to a respective amplifier 29 (e.g. FIG. 3). Such amplifiers increase strength of audio signals reaching and passed from microphones 28*a*, which can be faint in many cases, since microphones 28*a* are not worn by or otherwise positioned directly in front of the mouths of speaking individuals.

Figure 3:
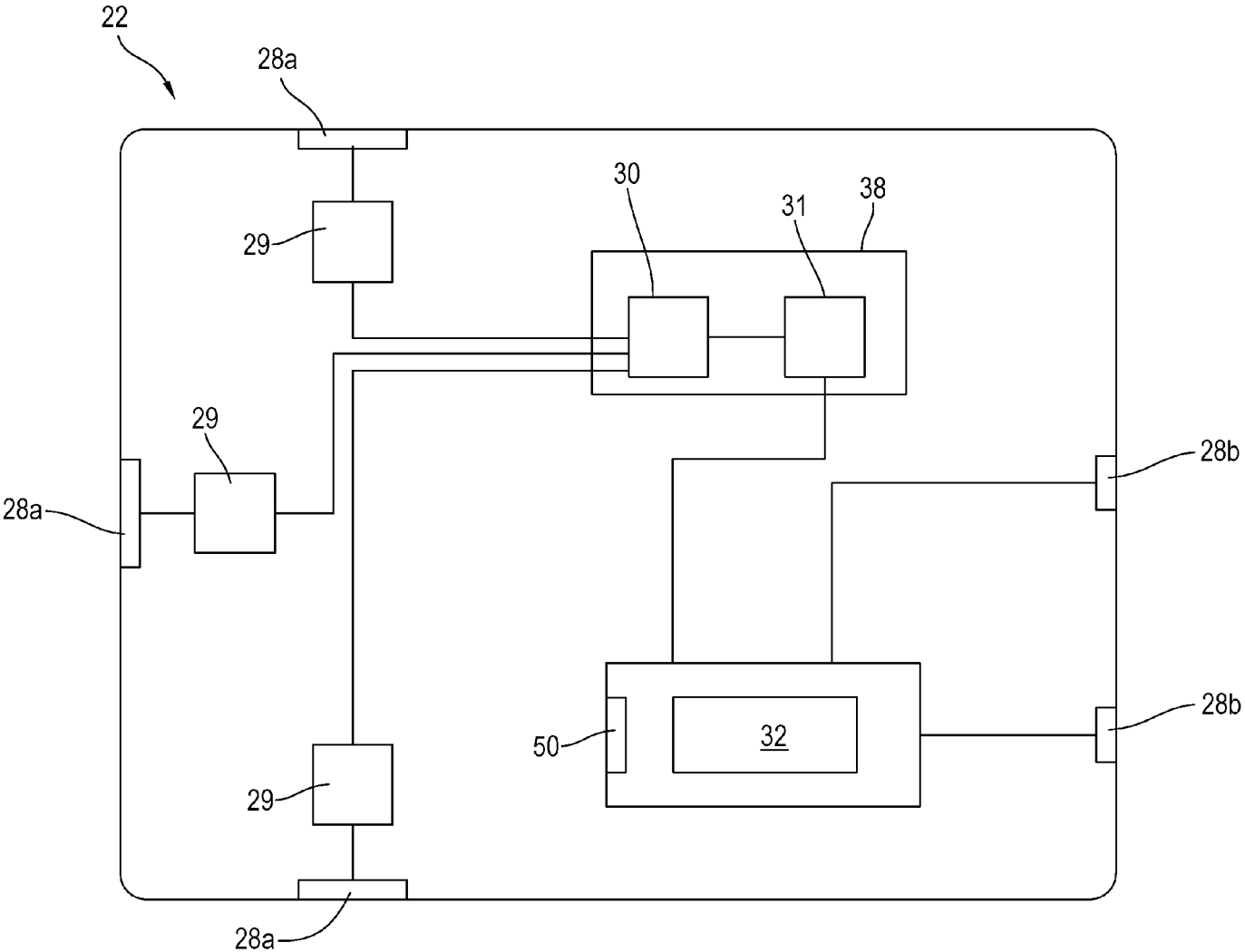
FIG. 3 is a schematic representation of internal operating parts of a portion of the embodiment of FIG. 1.
Figure 4:
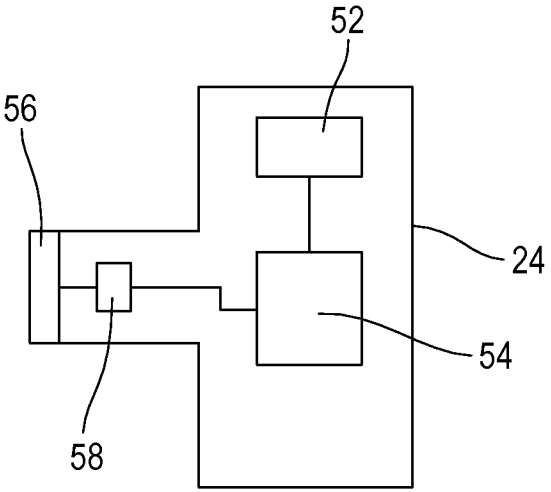
FIG. 4 is a schematic representation of internal operating parts of a portion of the embodiment of FIG. 1.

Audio signals received by input(s) 28 are transferred electronically to one or both of equalization circuit or device 30 and volume control circuit or device 31. In particular embodiments, a single processor (e.g. circuit board) 38 within housing 34 includes both equalization circuit or device 30 and volume control circuit or device 31. Thus, as indicated in FIG. 3 received audio signals are transferred to processor 38 from microphones 28*a* (via amplifiers 29) and/or jack(s) 28*b*. The audio signals may be automatically sent to both equalization 30 and volume control 31, or may be divertible via one or more switches (not shown) to one or the other. Level switches (not shown) for determining a type or level of equalization and/or for determining a level of strengthening or limiting of volume or output. If the above-noted switches are provided, naturally a knob, tab or other physical activator of the switch (es) will be in or extend from housing 34 for access by the user. In a particular embodiment, audio signals from input(s) 28 are transferred (perhaps via amplifiers 29) to equalizer 30, then on to volume control 31, so that equalized signals are boosted or limited prior to sending to transmitter 32. Another amplifier may be placed between processor 38 (or one or both of equalizer 30 and volume control 31) and transmitter 32 as well.

Transmitter 32 receives signals from processor 38 (e.g. one or both of equalizer 30 and volume control 31). In the illustrated embodiment, transmitter 32 includes one or more components or circuits for altering or transforming an input signal into a desired form or condition for transmitting, as discussed below. In particular, transmitter 32 includes hardware or software for creating digital signals from the signals from processor 38 (e.g. an analog-to-digital converter) in embodiments in which the inputted audio signals are analog signals. In embodiments in which the inputted signals are initially digital in form, transmitter 32 may not need such a converter or it may be bypassed. The digital signals (representing the original audio signals as electronically treated) are formatted into digital information packets for transmission by transmitter 32. The packets include information of the digital audio signal and a code or password embedded in or attached to the signal that is specific to the transmitter 32. As one example, transmitter 32 is a Bluetooth or Bluetooth-compatible transmitter, using established Bluetooth data formats and protocols. While in the illustrated embodiment transmitter 32 includes any necessary A-to-D conversion and/or packet formatting hardware or software, so as to conserve space and reduce size of housing 34, it is contemplated that other embodiments may have separate converter and/or formatter structure electronically connected between processor 38 (or specific parts 30 and/or 31) and transmitter 32.

Transmitter 32 transmits the digital information packets to the surrounding area. Bluetooth-type embodiments of transmitter 32 are low-power devices, having a range of between about 1 and 50 meters (about 3 to 150 feet), especially about 10 to 25 meters (about 30 to 75 feet), and transmitting at a power of about 1 to 100 milliwatts, especially about 2.5 to 10 milliwatts. Transmissions from transmitter 32 are preferably in a short-wave band such as the industrial, scientific and medical (ISM) bands, for example those in the 2.4 gigahertz frequency range.

Transceiver 22 further includes a power source 48 that may be an AC or DC source in particular embodiments. The illustrated embodiment shows a battery 50 provided for DC power. In particular embodiments, a rechargeable battery is provided, having as one example a charge-life of about 1-20 hours, such as about 6-10 hours. In such embodiments, a charging port 51 may be provided for connection to a wall outlet or other external source for recharging battery 50. A preferred such charging port is one designed for or compatible with a mobile telephone, for convenience and efficiency. In a particular example, an input jack 28*b* may be used for both input of audio signals, as noted above, and for charging battery 50, as where separate wires in jack 28*b* are connected to a plug-in during charging than are connected for audio input. While a rechargeable battery 50 is advantageous in providing a pocket-sized or hand-carryable device as disclosed, embodiments may have an AC connection (e.g. with permanent or detachable AC power cord) for connection to a wall outlet.

As indicated in FIG. 3, transmitter 32 and battery 50 may be a part of an integrated circuit or circuit board. A USB connector or other type of jack input 28*b* may be a part of such a circuit or circuit board or be included with transmitter 32 in some embodiments. A function selector switch (not shown) may be provided in the circuit or circuit board to allow the user to choose what input(s) to use. If such a selector switch is provided, it will naturally have a knob, tab or other physical activator accessible to a user in or extending from housing 34.

Earpiece 24 includes a receiver 52, a processor 54, and a speaker 56. Receiver 52 receives signals transmitted by transmitter 32. Thus, receiver 52 is prepared or programmed to be able to receive transmissions of the frequency of those sent by transmitter 32. A signal received by receiver 52 moves to processor 54. Processor 54 analyzes the digital packet received by receiver 52 to see whether it has a code or password identifying transmitter 32 of transceiver 22. If such a code is present, processor 54 processes the digital packet's information of audio signals into a digital or analog signal and sends it to speaker 56. Speaker 56 transforms the signal from processor 54 into sound—i.e. the audio signals originally received by input(s) 28 of transceiver 22—for the user. In illustrated embodiments, speaker 56 is at least partially inserted into or directed toward user's ear canal, so that most or all of the sound generated by speaker 56 goes directly to the user. Embodiments of earpiece 34 can also include a volume control 58 (e.g. an amplifier) electronically connected between processor 54 and speaker 56 to increase or decrease volume as the user may need. Control 58 may provide a three-step control, e.g. a high, medium, and low-volume setting, or may have a continuous gain control to allow the user to set volume at any desired point between a minimum and maximum. In a particular embodiment, earpiece 24 is a Bluetooth-compatible receiver specifically linked with transmitter 32, so that earpiece 24 can receive and reproduce (at speaker 56) only sound-representative signals sent by transmitter 32.

The use of an embodiment of system 20 will now be described in the context of a meeting in a conference or meeting room. It will be understood that other uses of embodiments of system 20 are contemplated, as indicated further below.

A user carries system 20, including transceiver 22 and earpiece 24, with him or her, as in a pocket or bag, in view of the lightweight and small or non-bulky nature of system 20. When the user arrives at the meeting, transceiver 22 is placed in a generally central location or a location near where people will be speaking, such as in the middle or toward one end of a conference table. If transceiver 22 is not charged or otherwise requires AC power, it may be plugged into wall or building current. The embodiment of transceiver 22 shown in FIG. 1 includes microphones 28*a* in three of the four lateral sides. Such an embodiment may be placed on a table oriented so that the side without a microphone 28*a* is generally toward the user, and with microphones 28*a* directed generally toward other speakers. In other embodiments in which microphones 28*a* are in all sides, a particular direction or orientation of transceiver 22 is not necessary. In embodiments in which microphones are not distributed or located around housing 34 of transceiver 22, the location or orientation of transceiver 22 can be determined so that microphones on it are generally pointed toward individuals who will speak. Transceiver 22 and earpiece 24 are turned on, and earpiece 24 is placed on or near the user's ear so that speaker 56 is within or pointed toward the user's ear canal.

During the meeting, sound or other audio signals (e.g. from other individuals' speech) is received by microphones 28*a*. Of course, if jack input 28*b* is used (as by plugging in input from computer or sound system) audio signals may be received by jack 28*b* as well or instead. Audio signals received by microphones 28*a* are electronically amplified by respective amplifier(s) 29 and forwarded to processor 38 for equalization and/or volume control. Audio signals received by jack 28*b* are forwarded to processor 38, without amplification in the illustrated embodiment. The processed audio signals move electronically to transmitter 32, which as described above is formatted into information packets with the digital form of the signal and a code or password unique to transmitter 22. The packets of information or signal are transmitted by transmitter 32.

Receiver 52 of earpiece 24 receives the packets of information or signal sent by transmitter 32. Processor 54 recognizes the password or code in the packets as indicating information sent by transmitter 22, and proceeds to process the signal. Other signals which do not have the password or code identifying transmitter 22 that may be received by receiver 52 are not processed. The processed signal is sent to speaker 56, which transforms it into sound directed into the user's ear. Speech from the meeting participants is collected by inputs 28, processed by processor 30 and transmitted by transmitter 32 to earpiece 24. Earpiece 24 transforms only the signals collected from transmitter 32, i.e. only the speech voice by the meeting participants (perhaps cleaned and amplified), into sound projected into the user's ear. The important sound in the room is thus sent directly to the user of system 22, without interference from other sounds or other transmissions.

The above example focuses on use of microphone(s) 28*a* as input(s) 28. It will be understood that if one or more jacks 28*b* are provided as input(s) 28, other sound signal sources may be plugged into one or more of such jacks 28*b*. A source of pre-recorded or other sound may be plugged into a jack for transmission to earpiece 24 as discussed above. For example, a speaker jack or USB connection from a computer might be connected to a jack input 28*b* of transceiver 22 so that internet-based sound (e.g. Skype conferences or telephone calls) is input into transceiver 22 and transmitted to earpiece 24. Similarly, in embodiments of transceiver 22 having a wireless input 28 for sound signals, computer, wi-fi, or other receivable transmissions can be received by input 28, and transmitted to earpiece 24 following processing by transmitter 32.

It is also noted that the example above includes transport of system 20 to the meeting or other area for use. System 20 is particularly effective for a single user to carry with him or her, for use as he or she deems necessary. However, it is also contemplated that individual systems may be maintained on hand by a host of a conference or meeting, e.g. by law firms or government bodies, for use by those attending. Use of such a system 20 is substantially as noted above, with the host placing transceiver 22 in an area to receive audio signals, and giving the related earpiece 24 to the user.

The example of use in a conference or meeting room is also merely exemplary. For example, transceiver 22 may be used with a television or other display showing audiovisual entertainment or other material. Inputs 28 may be linked with sound output of the display, as by directing microphones of transceiver 22 toward speakers of the display, or by connecting an audio output jack of the display to a jack input 28 of transceiver 22. Sound from the display is sent to earpiece 24 for the user's enjoyment. It has been found that such sound from a display does not suffer from a time lag that has been noticed when available FM-based broadcast systems are used with television systems. In the context of a visit to a museum or historical building, as another example, one or more inputs 28 of transceiver 22 may collect sound or signals from a tour guide or other speaker or signal source. For instance, the user can hold transceiver 22, which is lightweight and non-bulky, in a manner so as to collect the guide's spoken words via a microphone on transceiver 22. As another example, an antenna or other receiver for wireless signals in or on transceiver 22 may receive wireless signals from the tour guide or other signal source, and send the cleaned and amplified signal to earpiece 24.

The embodiments of system 22 discussed above provide a direct link between transceiver 22 and earpiece 24, for the use of one individual in contexts such as business meetings or personal sound amplification. It is also contemplated that embodiments of system 22 may have the capability of serving multiple users, for example in a meeting, tour or similar context. In such a system 22, transceiver 22 has multiple transmitters 32 within housing 34, each having a separate code, tag or password it sends with its digital packets. Multiple earpieces 24 are provided, each linked to a specific transmitter 32 (i.e., each respective earpiece 24 is programmed to accept and decode transmissions having only one respective transmitter's tag, code or password). Each such transmitter 32 receives signals from equalizer 30 and/or volume control 31, and transmits a respective digital signal intended for only a respective one of earpieces 24. Each earpiece 24 and each transmitter 32 can be individually powered and turned on and off in particular embodiments, so that only those earpiece(s) and transmitter(s) needed by individual(s) are powered and in use. Thus, for example, in a system 22 with six transmitters 32 and six earpieces 24, up to six people will be able to use system 22. Any such earpieces that are used are turned on by the user, and the respectively related transmitter is also turned on or powered, and system 22 is used otherwise as indicated above. Such embodiments of system 22 are easily portable, being held in a small housing 34 (yet perhaps somewhat larger than the dimensions noted above) and being of a small enough weight to be easily carried and supported on a table, desk or similar furniture, so as to be preferably used in conference or other meeting rooms where a relatively small number of individuals may need sound enhancement. Systems 22 with multiple transmitters 32 and earpieces 24 as described above may be employed to advantage in conference rooms or tours in which several people need hearing assistance.

Embodiments of system 20 provide one or more of a number of advantages over existing infrared- or FM-based sound broadcast systems. While infrared systems do not operate if the source and receiver are not in a line-of-sight relationship, embodiments of system 20 do not suffer in their performance if person(s) or furniture are positioned between transceiver 22 and earpiece 24.

It has also been observed that existing devices for assistive hearing can experience a time-lag, meaning that sound heard by the individual is not in synchronization with observation of a speaker or program. For example, existing devices used in connection with a television program or movie can result in the sound lagging behind the video to an annoying degree. System 20 does not suffer from such lag. Clarity for the user is enhanced by the digitalization of sound. Both transceiver 22 and earpiece(s) 24 may be rechargeable with available chargers so as to provide service for a substantial period while the user is on the go. A one-to-one correspondence of transmitter and earpiece, as described above, is believed to be more efficient in use of transmitter power, and makes system 20 self-contained, lightweight, and portable at a much smaller expense than existing FM-broadcast-based systems. System 22 further permits use or maximization of specific inputs (e.g. television or home-theater programs, spoken words or transmissions from a guide, or discussion from a meeting via voice or microphone). These and other benefits over existing technology flow from the present disclosure.

While the subject matter herein has been illustrated and described in detail in the exemplary drawings and foregoing description, the same is to be considered as illustrative and not restrictive in character, it being understood that only the preferred embodiment(s) have been shown and described and that all changes and modifications that come within the spirit of the disclosure are desired to be protected. It will be understood that structures, methods or other features described particularly with one embodiment or part can be similarly used or incorporated in or with respect to other embodiments or parts.

What is claimed is:

1. A system for assistive hearing, comprising:

an earpiece for positioning at or adjacent a user's ear, said earpiece having a receiver, a volume control, and a speaker; and a transceiver in a housing that is sized to be carried in one or both hands of a user, said transceiver including at least one input for audio signals, a processor for at least one of equalizing and controlling volume related to the audio signals, and a transmitter for digitally transmitting signals from said processor, wherein said earpiece is adapted to receive and send to said speaker only digital signals from said transmitter, so that audio signals received by said input of said transceiver are transformed into sound by said speaker with no user-appreciable time lag, wherein the volume control of the earpiece is electronically connected between the receiver and the speaker and is directly adjustable by the user when receiving signals from the transmitter, and wherein said housing includes at least three external walls facing in different directions from each other, and said at least one input includes at least one respective microphone in each of the three respective walls, whereby the microphones are pointed generally in different respective directions to pick up sound coming generally from those different respective directions.

2. The system of claim 1, wherein said at least one input includes at least one jack input.

3. The system of claim 2, wherein said at least one jack input is a coaxial jack input.

4. The system of claim 2, wherein said at least one jack input is a USB port.

5. The system of claim 1, wherein said housing includes a bottom surface adapted for placement on a horizontal non-floor surface.

6. The system of claim 1, wherein said transmitter has an effective range of about 30 to 200 feet.

7. A system for direct personal transmission of sound, comprising:

a transceiver having a housing sized to be carried in one or both of a user's hand and having a perimeter wall;

at least one microphone in said perimeter wall for receiving sound from outside of said housing and converting it to an electronic audio signal, and at least one amplifier electronically connected to said at least one microphone for amplifying said electronic audio signal, wherein said perimeter wall of said housing includes at least three sides each facing in a different direction, and wherein a respective microphone of said at least one microphone is placed to face outward from each of said sides, and each said microphone has a respective amplifier of said at least one amplifier;

at least one signal input for receiving electronic audio signals from outside said housing;

a processing circuit electronically connected to said at least one amplifier and said at least one signal input, said processing circuit having one or both of an equalizer and a volume control, said processing circuit receiving one or both of said electronic audio signals for at least one of equalization and volume alteration; a rechargeable power source; and a transmitter electronically connected to said processing circuit for transmitting signals received from said processing circuit in digital packets, said digital packets including digital information derived from said electronic audio signals and identifying information that identifies said transmitter, said transmitter transmitting said digital packets at a predetermined frequency; and an earpiece having a receiver, a processing circuit and a speaker, said receiver adapted to receive said predetermined frequency, said processing circuit adapted to analyze packets received by said receiver for said identifying information, and for packets having said identifying information passing said digital information derived from said electronic audio signals electronically to said speaker, wherein said speaker produces sound represented by said electronic audio signals.

8. The system of claim 7, wherein said transmitter is a low-power transmitter in the ISM bands.

9. The system of claim 7, wherein said at least one signal input includes a coaxial audio jack.

10. The system of claim 7, wherein said at least one signal input includes a USB port.

11. The system of claim 7, wherein said at least one signal input includes an over-the-air signal receiver.

12. The system of claim 7, wherein said at least one signal input includes a coaxial audio jack and a USB port.

13. The system of claim 7, wherein said rechargeable power source is a battery having a life of at least twenty hours, and further comprising a recharging jack in said housing electronically connected to said battery.

14. The system of claim 7, wherein said system includes at least two transmitters in said housing, and as many earpieces as there are transmitters, each respective said earpiece adapted to receive and process digital packets from only a respective one of said transmitters.

15. The system of claim 7, wherein said earpiece includes a volume control, and said volume control of said earpiece is operable by a wearer during operation of the transmitter.

16. The system of claim 15, wherein said volume control of the earpiece is electronically connected between the receiver and the speaker.

17. The system of claim 7, wherein the electronic audio signal from the at least one microphone is an analog signal, the analog signal being converted to a digital signal for transmission by the transmitter to the earpiece.

* * * * *